US006158613A

United States Patent [19]

Novosel et al.

[11] Patent Number: 6,158,613

[45] Date of Patent: Dec. 12, 2000

[54] VOICE BASED PHARMACEUTICAL CONTAINER APPARATUS AND METHOD FOR PROGRAMMING

[75] Inventors: David Novosel, New Wilmington, Pa.; Alexandra M. Pladys, Carol Stream, Ill.

[73] Assignee: Voice Based Products, Inc., West Middlesex, Pa.

[21] Appl. No.: 09/090,551

[22] Filed: Jun. 4, 1998

[51] Int. Cl.[7] ..... G07F 11/00

[52] U.S. Cl. ..... 221/3; 221/7

[58] Field of Search ..... 221/1, 2, 3, 7, 221/9, 15; 700/225, 231, 244, 233

[56] References Cited

U.S. PATENT DOCUMENTS

| | | | |
|---|---|---|---|
| 4,448,541 | 5/1984 | Wirtschafter | 368/10 |
| 4,572,403 | 2/1986 | Benaroya | 221/3 |
| 4,695,954 | 9/1987 | Rose et al. | 221/3 |
| 5,291,191 | 3/1994 | Moore | 221/3 |
| 5,347,453 | 9/1994 | Maestre | 364/413 |
| 5,495,961 | 3/1996 | Maestre | 221/3 |

*Primary Examiner*—Kenneth W. Noland
*Attorney, Agent, or Firm*—Harpman & Harpman

[57] ABSTRACT

A voice announcement medication storage and dispensing device for patients. The storage and dispensing device comprises a medical storage portion and a closure portion with data storage means disposed within the closure portion. The device is activated by access to the storage container and can be programmed with medication information including medication dosage, schedule, medical warnings and patient information. The medication storage and dispensing device has a self-contained power source with a data processing and memory chip and electronic data interface with audio data output.

14 Claims, 4 Drawing Sheets

VOICE BASED PHARMACEUTICAL CONTAINER APPARATUS AND METHOD FOR PROGRAMMING

BACKGROUND OF THE INVENTION

1. Technical Field

The present invention relates to medication information and alarm devices that are programmed with medication information and timing sequences for the proper administration of the medication contained within.

2. Description of Prior Art

Prior art devices of this type have relied on a wide variety of different medication systems that provide audible and visual alarms to the patients to indicate proper dosage times as well as last access time to the medication container. This type of information and indicators are needed considering the number of patients that are infirmed and take multiple drugs which may inter-react with one another if not taken in accordance with prescription instructions. While medication bottles have labels stating the patient's name, type of drug, dosage and any associated warnings, many patients are still unaware of the contents of their prescription container. This is especially true for the elderly and infirmed or moderately mentally disabled patients. It is therefore a major problem with these individuals to comply with their treatment directions. Some patients cannot readily understand and act on the label information or alternately they forget to take their medication at the proper time or skip a dosage which may be critical to the effectiveness of the medication.

Prior art patents have attempted to respond to this problem with a number of medication alarms and visual reminders, see for example U.S. Pat. Nos. 4,448,541, 4,572,403, 5,347,435 and 5,495,961.

In U.S. Pat. No. 4,448,541 a medical timer apparatus is disclosed having a magnetic and pressure activated switch that once activated indicates a timed alarm unit on the medication container. This device is activated by the patients gripping the container or opening it, resetting the time to the next dosage alarm required.

U.S. Pat. No. 4,572,403 is directed to a timed dispensing system in which multiple dosages of medication can initially be placed and that are accessible only at the appropriate time and the appropriate amount.

U.S. Pat. Nos. 5,347,453 and 5,495,961 disclose and claim portable programmable medication alarms and proper dosage use requirements. These devices use audible alarm signals and generate graphic representation of the prescribed administration time, dosage amount and medical instructions. The devices are programmable by a central computer through an interface device.

SUMMARY OF THE INVENTION

A pharmaceutical storage container having a self-contained disposable audible message unit that can be pre-programmed with critical use information for the individual patient. The disposable audible message unit is activated by access to the storage container and can be reprogrammed by the pharmacist with use of a programming interface module and input data supplied by software in a medical database and specific manual input data by the pharmacist.

DESCRIPTION OF THE PREFERRED EMBODIMENT

Figure 1:
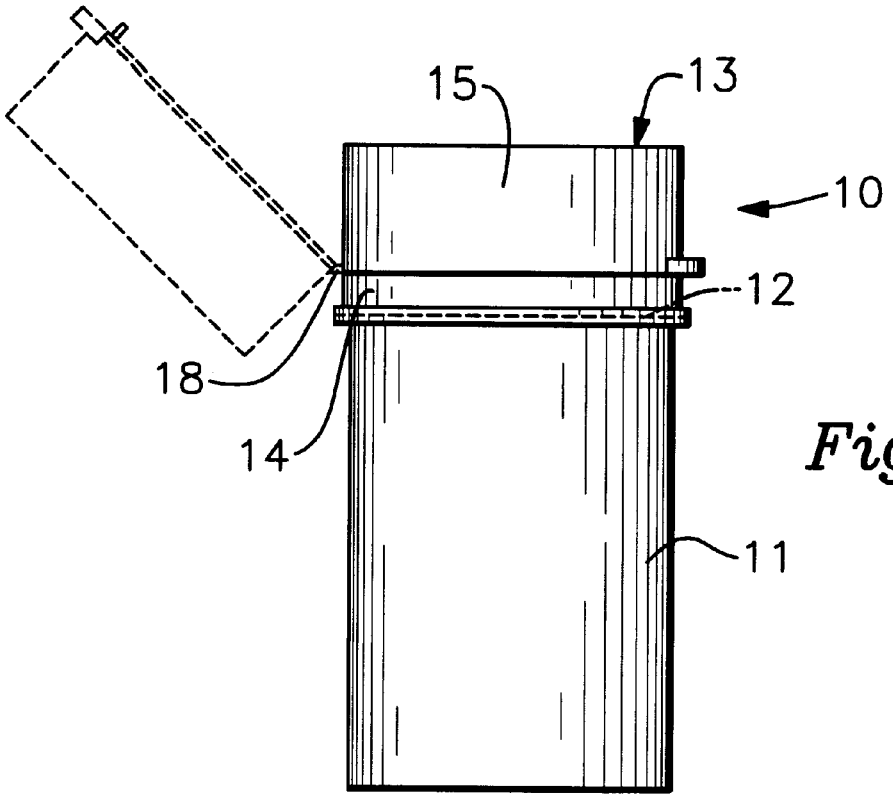
FIG. 1 is a front elevational view of the programmable storage container of the invention.
Figure 2:
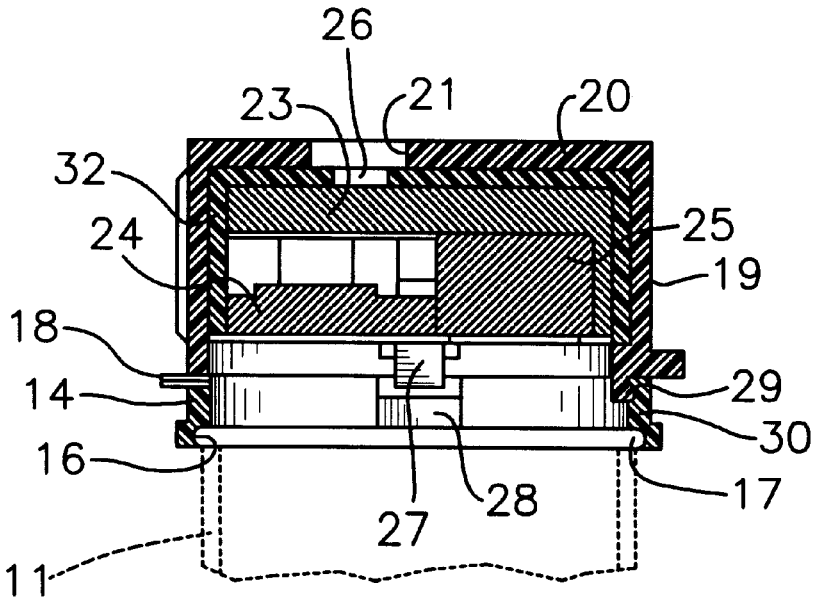
FIG. 2 is an enlarged cross-sectional view of the programmable access closure of the container of the invention.
Figure 3:
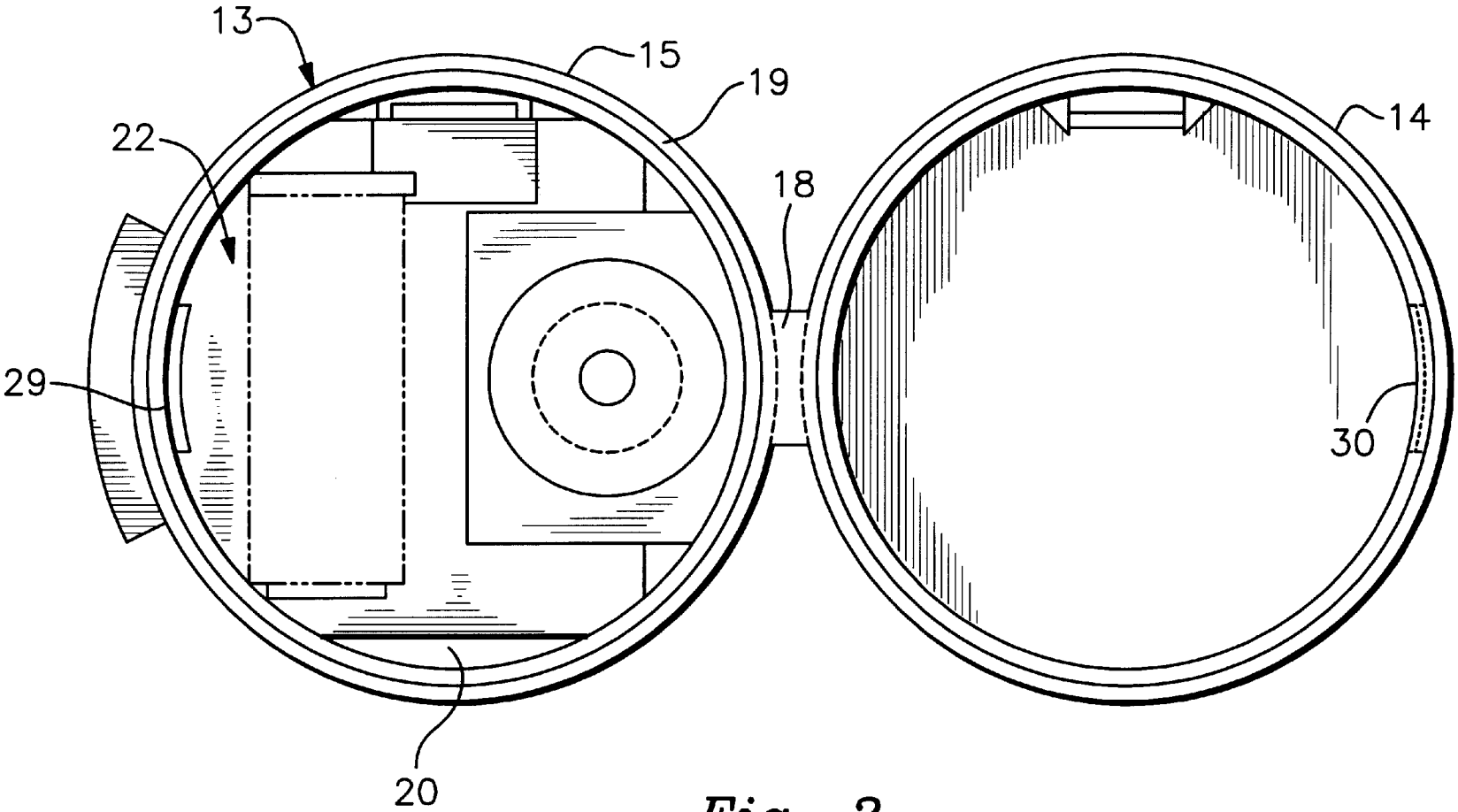
FIG. 3 is an enlarged top plan view of the programmable access closure in open position of the invention.

Referring to FIGS. 1–3 of the drawings, a pharmaceutical container 10 is shown having a main body member 11 with an open end at 12. A programmable closure 13 is removably secured to the open end 12 of the container 10 having an annular engagement ring 14 and interconnected cap portion 15 (arranged for selective registration therewith). The engagement ring 14 has in this example, chosen for illustration, an internal annular recess at 16 that is registerable over a corresponding annular flange 17 on the main body member 11. A "living" hinge 18 interconnects the retaining ring 14 with the cap portion 15 allowing for hinged access to the contents of the container 10 as best seen in FIG. 3 of the drawings and illustrated in broken lines in FIG. 1 of the drawings.

The interconnected cap portion 15 has an annular sidewall 19 with an integral top portion 20 extending therefrom and associated opening at 21 within as will be described in detail hereinafter.

A self-contained information module 22 has a programmable integrated circuit 23 with an interconnected output speaker 24 and power source (battery) 25 within is inserted into the cap portion 15. The programmable integrated circuit 23 has a docking data port interface 26 that is accessible through the opening 21 in the top portion 19 as hereinbefore described. It will be apparent to those skilled in the art that such information port interface 26 can be configured in a variety of alternate ways including, but not limited to direct electronic induction techniques and a variety of different multiple registration pin configurations all of which are typical within the art.

An activation switch assembly 27 on the module 22 is engageable on a registration portion 28 of the retaining ring 14 so that upon opening of the cap 15 the information module 27 is activated. The cap portion 15 has an arcuate flange 29 that is registerable with a corresponding portion 30 of the retaining ring 14, best seen in FIGS. 2 and 3 of the drawings.

The components of the activation module 22 as hereinbefore described are secured within a mounting fitting 31 which has an annular sidewall 32 that is of a known diameter less than that of the known interior dimension of the cap portion 15.

Figure 5:
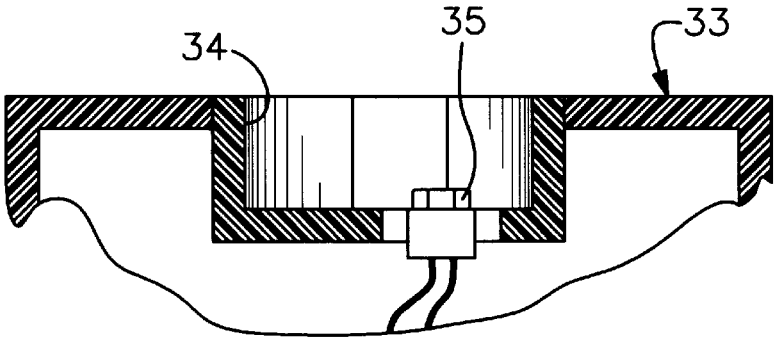
FIG. 5 is an enlarged partial cross-sectional view of a programmable part of the programming interface of the invention.

Referring now to FIG. 5 of the drawings, an enlarged partial cross-sectional view of a programming interface module 33 can be seen to illustrate a container receiving port 34 within having a data transfer probe 35 extending therefrom which is registerable within the data interface 26 within the cap portion 15 as hereinbefore described.

Figure 4:
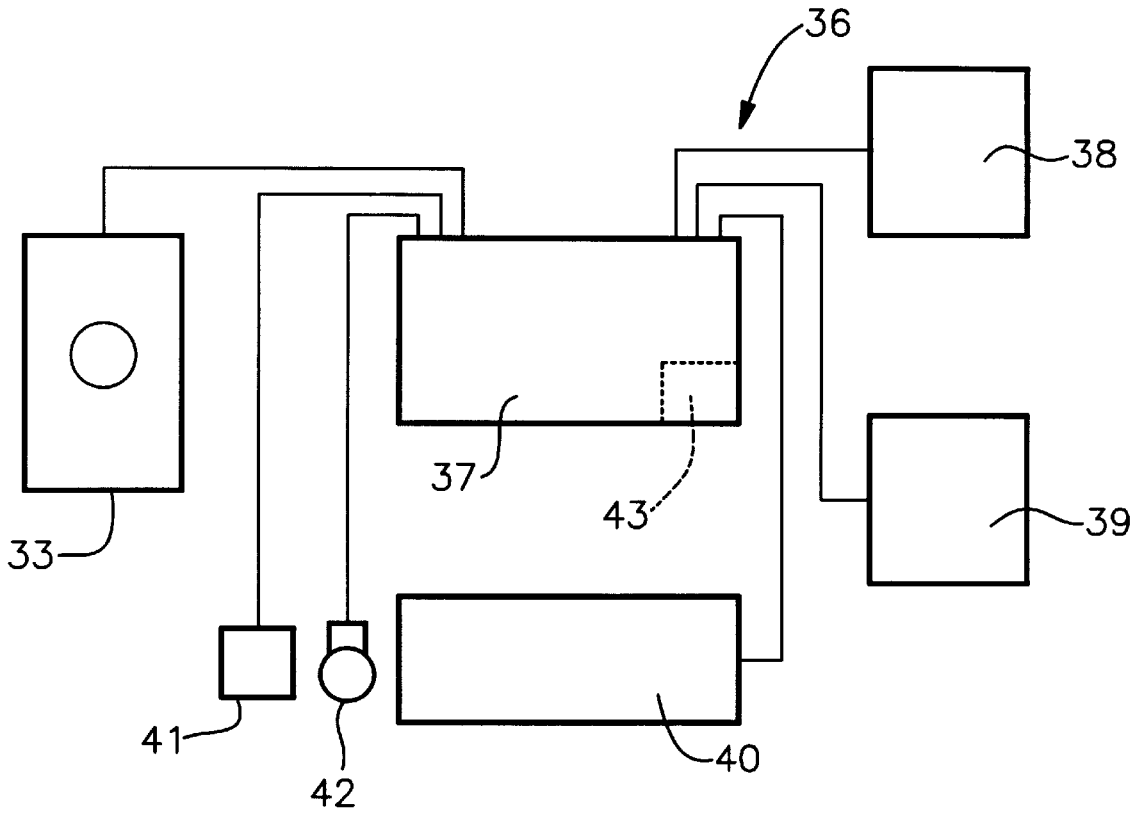
FIG. 4 is a system block diagram of the pharmacy computer and storage container program interface of the invention.

The programming interface module 33 is linked to a personal computer (PC) system 36 as seen in FIG. 4 of the drawings. The (PC) system 36 is that of which is typically found in most pharmacies today comprising a main computer unit 37, with an interconnected monitor 38 and printer 39. A keyboard 40, a mouse 41 and mic 42 provide user input devices along with the well known internal CD rom drive 43 indicated by the dotted lines within and the programming interface module 33 as hereinbefore described.

Figure 6:
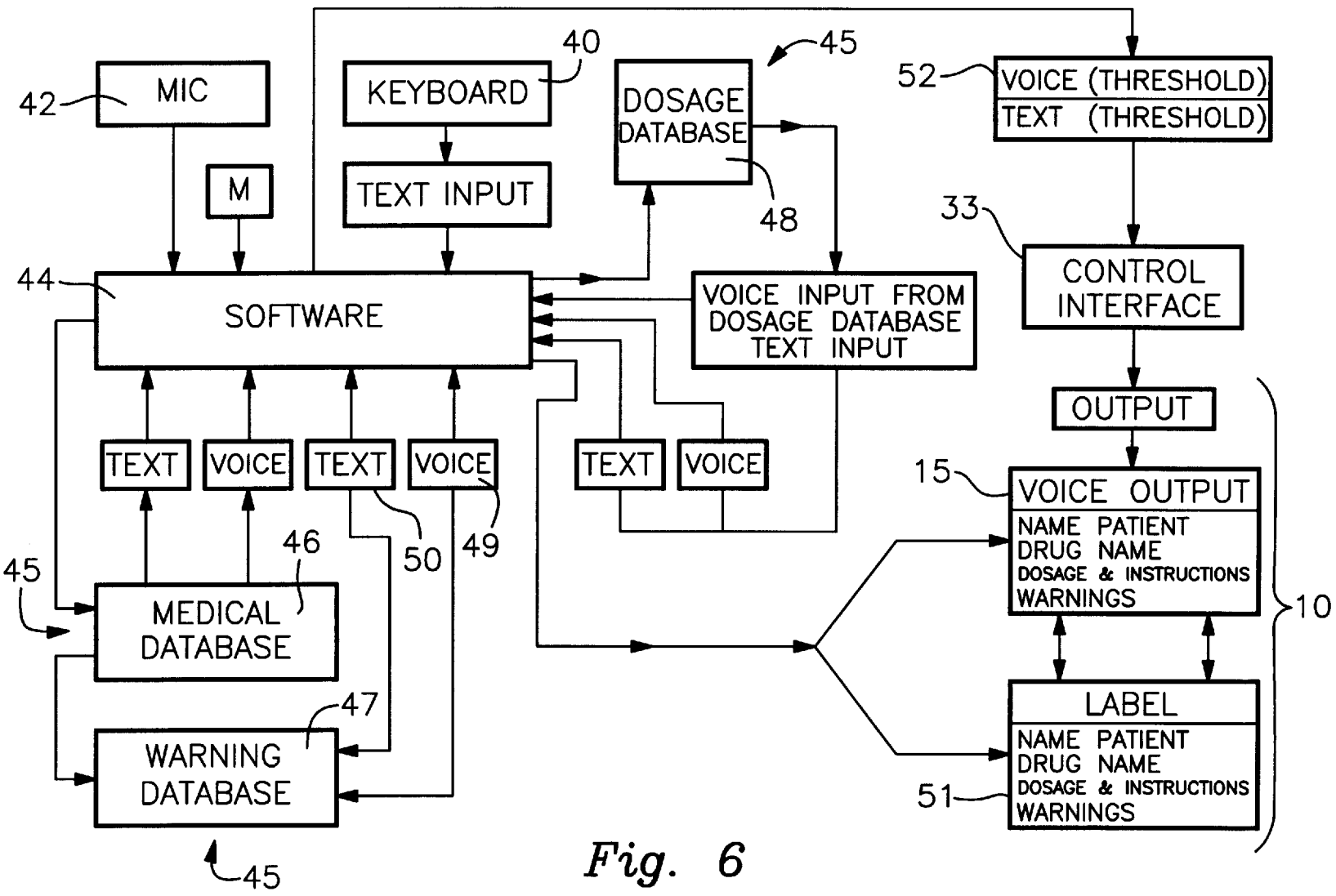
FIG. 6 is a schematic block flow diagram of the data flow by software and related data banks illustrating the programmable information origins and inter-relationships for retrieving and outputting same.

Referring now to FIG. 6 of the drawings, a schematic block flow diagram is used to illustrate the method of the invention accomplished by the integration of a custom software program 44 with action specific databases 45 and data input mechanisms such as the computer keyboard 40, mouse 41 and mic 42.

Accordingly, in operation, the pharmaceutical container 10 of the invention is programmed by physical interengagement with the programmable interface 33 which in this example is achieved by inverting and inserting the container 10 into the receiving port 34 and aligning same with the transfer probe 35 within the access opening 21 of the container cap portion 15.

Patient's specific information including patient name, name of medication, dosage amount and schedule along with output language request is inputted into the system by a combination of voice (of the mic 42) for the patient name and remaining information in text via the keyboard 40. The software program 44 will search the action specific databases 45 that include a medical medication database 46 including drug name and an associated medication warning database 47 and a dosage schedule database 48 which are inter-related to one another by their contents. Each of the respective databases have both voice data 49 and text data 50 output capabilities to the software 44. The appropriate data retrieved is then outputted by the software 44 to the programmable interface unit 33 and then downloaded into the integrated circuit (IC) in the cap portion 15 of the container 10 via the hereinbefore described data interface 26.

Text output of the patient's specific medication information retrieved is correspondingly outputted to the printer 39 of the system generating a prescription label 51 as is normally found on prescription bottles.

During initial use information input a language selection/translation can be changed for the voice and text data output by software access of a voice to text and text to voice and language translation programs 52 as an appropriate output source.

Referring now to FIG. 7 of the drawings, components of the integrated circuit 52 indicated as inclusive of the dotted line are illustrated including and combining a programming interface 53 (communication port), a central processor 54, a non-volatile memory 55, and oscillator 56 with fixed frequency, a digital to analog converter 57 and a differential power amplifier 58 with associated speaker 59. A clock circuit 60 is contained within the IC chip and a switch 61 for activation of same.

The clock circuit 60 would provide a timing component for the container 10 having the dosage data alarm activation by the control processor 54 indicating to the patient time to take the medications by audio voice commands through the speaker 59. The clock circuit 60 could also calculate the last time the cap portion 15 of the container 10 was open and effective time between patient access to the container, if desired.

Program access security codes can be inserted through the software 44 to restrict programming access to the container 10 as well as testing codes to verify the working status of the container components prior to programming by the pharmacist.

To achieve operational playback of the pre-programmed data in the container, the following sequence is achieved. Upon switch 61 activation, the control processor 54 of the integrated circuit will begin to load data contents of the non-volatile memory 55 into the digital to analog converter 57. Data flow is regulated by the oscillator 56 ensuring a constant pace. The converted digital data 62 is then outputted as analog signal to the differential power amplifier 58 for the audio output by the speaker 59. By use of the above described integrated circuit and programming configuration, the programmable integrated circuit 23 of the invention can be reprogrammed by the pharmacist if changes or modifications are required. More practically, the container 10 of the invention along with the programmable closure 13 is simply discarded after the medication has been dispensed.

The software 44 can program the container 10 so as to time access specific requirements wherein other predetermined messages may be included with the initial programming to respond to effective count of activation openings of the container and impart special instructions to the patient should those parameters be exceeded or not complied with.

Referring back to FIGS. 1–3 of the drawings, a finger engagement flange 53 can be seen extending from the cap portion 15 of the closure 13 so as to provide a convenient engagement surface for the user to open the cap 15 and hinge it back on the "live" hinge 18 from the retaining ring 14.

It will be evident from the above description that alternate latch configurations for the cap 15 to the retaining ring 14 can be integrated into the current cap design such as providing so-called child resistant type openings in which a portion of the cap 15 would have to be depressed, for example, and lifted simultaneously or other adapted structural configurations could be achieved so that specific areas of the cap would have to be moved or aligned before the latch of the design would open, etc.

It is therefore evident that such changes would not diminish from the nature of the invention which is to include a programmable self-contained disposable voice output module within the cap of a pharmaceutical container to provide the information concerning the nature of the patient, the medication, dosage, amounts, times as clearly defined and illustrated above.

It will also be apparent to those skilled in the art that various changes and modifications may be made to the invention as hereinbefore described without departing from the spirit of the invention.

Therefore We claim:

1. A voice announcement medication storage and dispensing device for patients comprising:

a pharmaceutical container having a medication storage portion and a closure portion, data storage means disposed within said container, said closure portion having a cap, said cap arranged for selective registration with said storage portion, means for activating said data storage means responsive to movement of said cap in relation to said medication storage portion, programming means for said data storage means with data representative of at least one prescribed medication dosage, schedule, medication warnings, and patient information, said data storage means comprising; a power source, a data processing and memory chip, an electronic data interface and audio data output means.

2. The voice announcement medication storage and dispensing device set forth in claim 1 wherein said data storage means is secured within said cap of said closure portion of said pharmaceutical container.

3. The voice announcement medication storage and dispensing device set forth in claim 1 wherein said means for activating said data storage means in response to cap movement comprises; switch means engageable with said closure portion.

4. The voice announcement medication storage and dispensing device set forth in claim 1 wherein programming means for said data storage comprises; a program interface module.

5. The device as set forth in claim 4 wherein said programming interface module comprises an electronic data interface port, a personal computer system, said personal computer system having multiple data input means including keyboard, mouse, and microphone, software in said PC system for manipulating, importing and retrieving data from said electronic input means and information databases for output.

6. The programmable interface set forth in claim 5 wherein said informational databases comprises; a medical medication name database, a medical/warning database, a dosage schedule database.

7. The programmable interface set forth in claim 6 wherein said information databases contain, text and voice output information means.

8. The programming means set forth in claim 1 further comprises; a text to voice conversion program and a translation program to selectively translate data into alternate languages for said output means.

9. The voice announcement medication storage device as set forth in claim 1 wherein said medication storage portion comprises; a container having a main body member with an annular sidewall defining a substantially circular opening in one end thereof, an annular flange adjacent said opening for registration with said closure portions.

10. The voice announcement medication storage and dispensing device set forth in claim 9 wherein said closure portion of said container comprises; an engagement ring, said ring is registerable on said annular flange of said container, an internal hinge extending between said engagement ring and said cap, means for selective registration of said cap with said engagement ring.

11. The voice announcement medication storage and dispensing device set forth in claim 10 wherein said means for selective registration of said cap with said engagement ring comprises; a latch flange extending from said cap portion engageable in registration portion on said retainer ring.

12. A method of programming and retrieving data from a voice announcement medication storage and dispensing container having a pharmaceutical data storage portion within comprises:

a. inputting patient specific information to a computer based CPU including
   (1). patient name
   (2). medication name
   (3). recommended medication dosage
   (4). language designation
   (5). ancillary patient instructions for medication
b. retrieving medication related information from multiple databases including
   1. medication name
   2. medication recommended dosage
   3. medication warning
      (3a). drug inter-reaction
      (3b). food and patient action issues
c. accessing a text to voice and voice to text conversion software based database
d. accessing a translation program
e. downloading retrieved medical data information and input patient data specific information in to said programmable data storage portion
f. storing said downloaded medical data information in an electronic storage medium
g. accessing said stored medical data in said data storage portion by movement of a cap in relation to said medication storage portion of said container
h. transmitting said retrieved storage medical data from said container by an audio output means in said data storage portion.

13. The method of programming the voice announcement medication storage and dispensing device set forth in claim 12 wherein said downloading of said retrieved medical data information and patient data specific information to said programmable data storage portion comprises:

a. outputting said inputted and retrieved data to a programmable interface device
b. interconnecting a data interface of said pre-programmed interface device with said programmable data storage portion of said medical pharmacy container
c. transferring inputted and retrieved processed data to said programmable data storage portion.

14. The method of programming and retrieving data from a voice announcement medication storage and dispensing device set forth in claim 12 wherein accessing stored medical data comprises:

a. activating said data storage portion of said container
   1. opening a closure on said pharmaceutical container
b. retrieving information from said data storage device by transmitting same through said output means within said container
c. deactivating said device in accordance with closing said closure of said pharmaceutical container
d. resetting said programmable memory module of said container in accordance with pre-programmed instructions concerning access count in accordance with associated time
e. activating a clock within said pharmaceutical container corresponding to a pre-programmed designated time activation sequence for next dosage, announcement warning, ancillary information output through said output means.

* * * * *